US006615737B2

(12) United States Patent
Bonnel et al.

(10) Patent No.: US 6,615,737 B2
(45) Date of Patent: Sep. 9, 2003

(54) SAFETY IGNITER FOR A PYROTECHNIC MUNITION COMPONENT CAPABLE OF BEING SUBJECTED TO SLOW COOK OFF

(75) Inventors: Alain Bonnel, Sorgues (FR); Dominique Houdusse, Itteville (FR); Bruno Nouguez, Paris (FR); Alain Tinet, Sorgues (FR)

(73) Assignee: SNPE, Paris (FR)

( * ) Notice: Subject to any disclaimer, the term of this patent is extended or adjusted under 35 U.S.C. 154(b) by 0 days.

(21) Appl. No.: 10/173,797

(22) Filed: Jun. 19, 2002

(65) Prior Publication Data

US 2003/0010246 A1 Jan. 16, 2003

(30) Foreign Application Priority Data

Jul. 13, 2001 (FR) ..... 01 09374

(51) Int. Cl.[7] ..... F42B 3/18; F42B 3/26
(52) U.S. Cl. ..... 102/481; 102/499; 102/202.1
(58) Field of Search ..... 102/464, 499, 102/202.14, 481, 202.1

(56) References Cited

U.S. PATENT DOCUMENTS 3,839,106 A * 10/1974 Dubois De Prisque et al. ..... 149/92
4,088,518 A * 5/1978 Kehren et al. ..... 149/93
4,270,455 A 6/1981 Janoski ..... 102/318
4,554,031 A * 11/1985 Kerviel et al. ..... 149/92
4,768,440 A * 9/1988 Deneuville et al. ..... 102/495
4,907,509 A 3/1990 Lieberman ..... 102/202.1
5,187,319 A * 2/1993 Nouguez et al. ..... 102/202.1
5,320,043 A * 6/1994 Andre et al. ..... 102/291
5,786,544 A * 7/1998 Gill et al. ..... 102/481

FOREIGN PATENT DOCUMENTS

BE 527 369 * 10/1956 ..... 102/464
GB 2 313 653 A 12/1997
WO WO 99/53264 10/1999

* cited by examiner

*Primary Examiner*—Stephen M. Johnson
(74) *Attorney, Agent, or Firm*—Oliff & Berridge, PLC

(57) ABSTRACT

A subject-matter of the present invention is a safety igniter for a pyrotechnic munition component capable of being subjected to slow cook-off comprising a structure in the form of a casing and a solid pyrotechnic charge present in the structure. This safety igniter, which is composed solely of a block of solid pyrotechnic composition based on pentrite, is intended to bring about the combustion without detonation of the pyrotechnic charge when the munition component is subjected to slow cook-off.

9 Claims, 1 Drawing Sheet

SAFETY IGNITER FOR A PYROTECHNIC MUNITION COMPONENT CAPABLE OF BEING SUBJECTED TO SLOW COOK OFF

The present invention relates to the general field of pyrotechnic munitions and more particularly to that of explosive munitions.

A particular subject-matter of the present invention is a safety igniter for a pyrotechnic munition component comprising a structure in the form of a jacket and a solid pyrotechnic charge present in the structure, the said igniter being intended to bring about the combustion without detonation of the pyrotechnic charge when the munition component is subjected to slow cook off.

BACKGROUND OF THE INVENTION

Stresses of thermal origin, such as kerosene or propellant fires, indirect heatings, can result in the pyrotechnic reaction of the munitions which are subjected to them.

Explosive-comprising munition components, such as missile warheads, bomb casings, penetrators and submarine munitions, can lead to violent blast or detonation reactions because of their high confinement.

To reduce these reactions to an acceptable level, that is to say to a simple combustion without projection of dangerous splinters, the use is known of a composite explosive charge based on inert polymer binders or energetic polymer binders charged with octogen (HMX), hexogen (RDX), nitroguanidine, ammonium perchlorate, triaminotrinitrobenzene (TATB), oxynitrotriazole (ONTA) and/or aluminium, in combination with a system for deconfinement of the structure of the munition.

The deconfinement system can consist of protective caps which can burst at a predefined pressure, which act as safety valve by releasing a discharge surface to the decomposition gases generated by the pyrotechnic reaction. Other techniques exist, such as the use of fusible components, of cutting cords or of incipient fractures.

This safety concept operates perfectly for intense fires of kerosene type. In this case, the very high temperatures are transmitted to the wall of the munition and then to the charge, which reacts by combustion at the structure/explosive interface as soon as the temperature exceeds the self-ignition temperature of the explosive, which is generally between 200° C. and 240° C. The combustion gases subsequently make their way to the discharge surfaces.

The case of less intense and longer lasting stresses is more complex.

The "slow cook off" stress is specified conventionally and consists in subjecting a munition component to heating by a few degrees per hour until it reacts pyrotechnically, which can occur after several tens of hours. These reactions can be very violent as they begin, in some cases, at the core of the pyrotechnic material in a medium which will have the time to decompose by pyrolysis of the binder and beginning of chemical decomposition of the active materials. Core initiations are frequently observed with large-calibre munitions (bombs, penetrators, submarine munitions). They are the consequence of the thermally highly insulating nature of the explosives and of the beginning of exothermic decomposition within the material. The heat given off cannot be discharged towards the outside and leads to an additional internal rise in the temperature which further accelerates the decomposition until the mass reaction. The greater the dimensions, the lower the reaction temperature.

A simple deconfinement system such as those mentioned above is insufficient in this case to limit the overall level of reaction.

It is known, to limit the level of reaction under slow cook off stresses, to insert, in the vicinity of the deconfinement device, a safety igniter which reacts by combustion at a temperature lower than the reaction temperature of the main charge of the pyrotechnic munition, the said combustion of the igniter leading to the combustion without detonation of the main charge.

U.S. Pat. No. 5,786,544 and GB 2 313 653 disclose such safety igniters, composed essentially of a plastic tube comprising an ignition powder or ignition pellets. The igniter is embedded in a ring of foam which separates it from the charge, in the rear part of the munition component, close to deconfinement holes.

The ignition pellets present in the tube are preferably composed of a mixture of boron and of barium chromate. In point of fact, it turns out that barium chromate is particularly toxic and carcinogenic and that it leads to hereditary genetic damage. Furthermore, under thermal stresses, it gives off fumes which are also highly toxic.

Other solutions relating to the nature of the ignition pellets are provided but none is truly satisfactory.

The use of pellets based on nitrocellulose-nitroglycerine double base propellant exhibits, for example, problems of migration of the nitroglycerine on storage, with the pyrotechnic risks which this results in.

There thus exists, for a person skilled in the art, a need for a safety igniter which makes it possible to provide the function described above but which does not exhibit disadvantages, such as those mentioned above.

DETAILED DESCRIPTION OF THE INVENTION

The present invention provides a solution to this problem and has, as main subject-matter, a novel safety igniter for a pyrotechnic munition component comprising a structure in the form of a jacket and a solid pyrotechnic charge present in the structure, the said igniter being intended to bring about the combustion without detonation of the pyrotechnic charge when the munition component is subjected to slow cook off.

This novel safety igniter according to the invention is characterized in that it comprises a block of solid composition based on pentrite and, preferably, in that it is composed solely of such a block.

Such a safety igniter is particularly simple to manufacture and to insert in the munition component. A single block, it exhibits sufficient intrinsic mechanical properties which do not require an inert housing, such as a plastic tube.

Furthermore, this block of solid composition based on pentrite is a detonatable material contributing additional energy in the context of normal use of the munition, which is not the case with the abovementioned igniters of the state of the art, which are not detonatable. This duality of function, safety igniter in the context of slow cook off and explosive in the context of normal use of the munition, which is specific to the present invention, is particularly advantageous.

It should also be noted that the constituents of the safety igniter according to the invention are neither toxic nor carcinogenic and that the combustion fumes are not particularly toxic.

It is known, in the state of the art, to use solid compositions based on pentrite as priming relay for explosive munitions. Patent Application PCT WO 99/53264 discloses, for example, such a use, which is unrelated to that of safety igniter which is a subject-matter of the present invention.

This known priming relay use dissuaded even a person skilled in the art from envisaging the use of these pentrite-based compositions in the function, described above, of safety igniter.

In the context of the present invention, "slow" cook off should be understood as cook off of between 0.5° C./h and 50° C./h, preferably of between 1° C./h and 20° C./h, even better still between 2° C./h and 10° C./h, for example approximately 3° C./h or 4° C./h.

Composition "based" on pentrite should furthermore be understood as a composition having a content by weight of pentrite≧5%, better still≧10% and better still≧25%, the maximum content by weight being approximately 98%.

According to a preferred alternative form of the invention, the block of solid pyrotechnic composition based on pentrite is a composite explosive (cast plastic bonded explosive). Composite explosives are generally well known to a person skilled in the art. They are obtained from explosive compositions with a plastic binder processed by casting and then polymerization and are composed of a charged plastic binder comprising at least one nitrated organic explosive charge, such as hexogen, octagen or pentrite. Other oxidizing charges, such as, for example, ammonium perchlorate, or reducing charges, such as, for example, aluminium, can also be present.

More specifically, to prepare the block of composite explosive based on pentrite used as safety igniter according to the invention, first of all the pentrite, and optionally the other explosive or nonexplosive charges, is/are mixed with a liquid polymerizable resin and optionally a plasticizer, and then the paste obtained is cast in a mould with the dimensions desired for the block. The paste is subsequently polymerized. According to the choice and the adjustment of the crosslinking agents, catalysts or wetting agents, composite explosives with varied characteristics are obtained.

The mould can be composed of a cavity machined into the solid pyrotechnic charge of the munition which it is desired to make safer.

According to a preferred alternative form, the plastic binder is a polyurethane binder, the content of which is preferably between 12% and 20% by weight with respect to the total weight of the composite explosive. Preference is given, among polyurethane binders, to those obtained by reaction of a hydroxylated polybutadiene with a polyisocyanate.

Other types of binders can be used, in particular silicone binders and polyester binders.

According to another alternative form of the invention, the block of solid pyrotechnic composition based on pentrite is a compressed explosive, that is to say an explosive with a plastic binder processed by compression. The base material (powder to be moulded) is composed of granules in which the charges are coated with a thermoplastic according to a technique well known to a person skilled in the art.

After reheating the powder to be moulded to a temperature such that the thermoplastic binder begins to soften, it is introduced into a heated mould and then compression is carried out under high pressure, of the order of $10^3$ bar.

According to another alternative form of the invention, the block of solid composition based on pentrite is a melt-cast explosive, for example a pentolite (mixtures of TNT and of pentrite), such as pentolite 20–80 (20% by weight of pentrite and 80% by weight of TNT) and pentolite 50-50.

Melt-cast explosives, which are well known to a person skilled in the art, are processed by casting in moulds a suspension of a granular explosive in a molten explosive, such as TNT.

According to another alternative form of the invention, the block of solid composition based on pentrite is a pentowax, that is to say a composition composed essentially of pentrite coated with a film of wax, such as beeswax or a synthetic wax.

The method of coating, for example under water, is well known to a person skilled in the art.

The content by weight of wax is preferably between 2% and 12%. Such compositions can also comprise additives, such as graphite and/or aluminium.

The processing of the pentowaxes is carried out by cold compression in the mould of a press.

In the context of the present invention, the block of solid pyrotechnic composition based on pentrite can have any shape.

Preferably, the block is provided in the cylindrical form and better still in the form of a cylinder generated by rotation generally having a diameter of between 2 mm and 50 mm.

The diameter of the block can be less than, equal to or greater than the critical diameter of the solid pyrotechnic composition based on pentrite constituting the block.

The cylinder can have any height. Use is generally made of diameter/height ratios of between 0.5 and 3 but, preferably, this ratio is in the region of 1 or greater than 1.

It has been found, with surprise, that the reaction temperature of the safety igniter, when the munition component is subjected to slow cook off, is a decreasing function of the diameter of the block and that it is thus possible to very easily predetermine the reaction temperature of the safety igniter as a function of the diameter of the block for a given composition and a given diameter/height ratio.

This particularly easy adjustment of the reaction temperature of the safety igniter offers an appreciable advantage in modifying the safety margins of a given munition or in using igniters with the same composition in munitions comprising pyrotechnic charges with different compositions.

Another subject-matter of the present invention is a pyrotechnic munition component comprising a structure in the form of a jacket, generally a metal jacket and for example a steel jacket, a solid pyrotechnic charge present in the structure, a device for deconfinement of the structure, for example a system such as mentioned above, and a safety igniter, also such as mentioned above and a subject-matter of the present invention, which makes it possible to bring about the combustion without detonation of the pyrotechnic charge when the munition component is subjected to slow cook off.

The solid pyrotechnic charge present in the structure is preferably explosive. In this case, the explosive charge is preferably a composite explosive but it can also, for example, be a compressed explosive, a melt-cast explosive, for example based on TNT, or a wax-coated explosive.

The solid pyrotechnic charge present in the structure can sometimes be a propulsive charge, for example a solid propellant, preferably a composite propellant.

Whether the charge is propulsive or explosive, the safety igniter makes it possible, in a slow cook off situation, to bring about the combustion without detonation of the charge but also without propulsion of the munition component, of the structure or of structural fragments.

According to a preferred alternative form of the invention, the safety igniter is situated close to the device for deconfinement of the structure, so as to facilitate the escape of the combustion gases.

According to another preferred alternative form of the invention, the igniter is at least partially embedded in the solid pyrotechnic charge. For this, it is possible, for example, to machine, in the charge, a housing for the igniter. Such a housing can also be produced during the manufacture of the charge by moulding using a removable core. The igniter is subsequently placed in the housing. Adhesive bonding can optionally be carried out in order to promote the maintenance of the igniter in the housing.

It is also possible, and preferable, during the manufacture of the charge by moulding to insert the safety igniter in the explosive paste after it has been cast and before it has been polymerized. After polymerization of the paste, the safety igniter is thus entirely integral with the charge.

The igniter can also not be at least partially embedded in the charge, that is to say be independent of the charge. It can, for example, be held on the structure using conventional bindings or alternatively can be embedded in a foam situated in a chamber inserted for the expansion of the gases close to the deconfinement device.

According to the present invention, when the munition component is subjected to slow cook off and when the temperature reaches the predetermined reaction temperature of the safety igniter, the latter ignites. The hot gases and the particles resulting from the combustion of the igniter then initiate the combustion of the charge of the munition, which burns without detonation or propulsion of the munition component, the structure or structural fragments.

Another subject-matter of the present invention is a process which makes it possible to bring about the combustion without detonation of a solid pyrotechnic charge present in the structure in the form of a jacket of a pyrotechnic munition component when the latter is subjected to slow cook off, the said munition component comprising a device for deconfinement of the structure and a safety igniter as mentioned above according to the invention which, during slow cook off, reacts by simple combustion at a temperature below the reaction temperature of the pyrotechnic charge and then brings about the combustion without detonation of the pyrotechnic charge.

BRIEF DESCRIPTION OF THE DRAWINGS

A longitudinal schematic cross section of 2 approximately cylindrical munition components according to the invention is represented in FIGS. 1 and 2.

According to these 2 figures, the munition component comprises:

Figure 1:
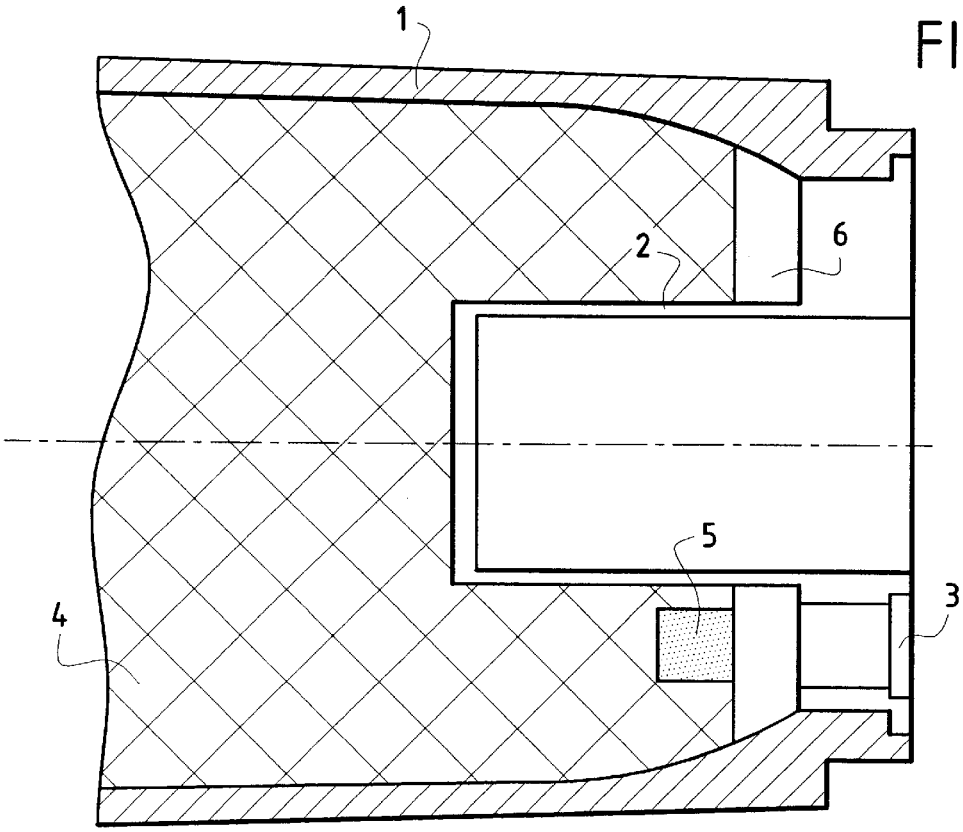

- a structure 1 in the form of an approximately cylindrical metal jacket,
- a metal component 2 which makes it possible to close off the munition,
- a device 3 for deconfinement of the structure 1,
- a solid pyrotechnic charge 4 present in the structure 1 and covered by the said structure 1,
- a safety igniter 5 composed of a cylindrical block of solid pyrotechnic composition based on pentrite,
- a chamber 6 for expansion of the gases.

According to the alternative form represented in FIG. 1, the cylindrical safety igniter 5 is completely embedded in the charge 4, one of its 2 flat circular faces constituting part of the wall of the chamber 6.

Figure 2:
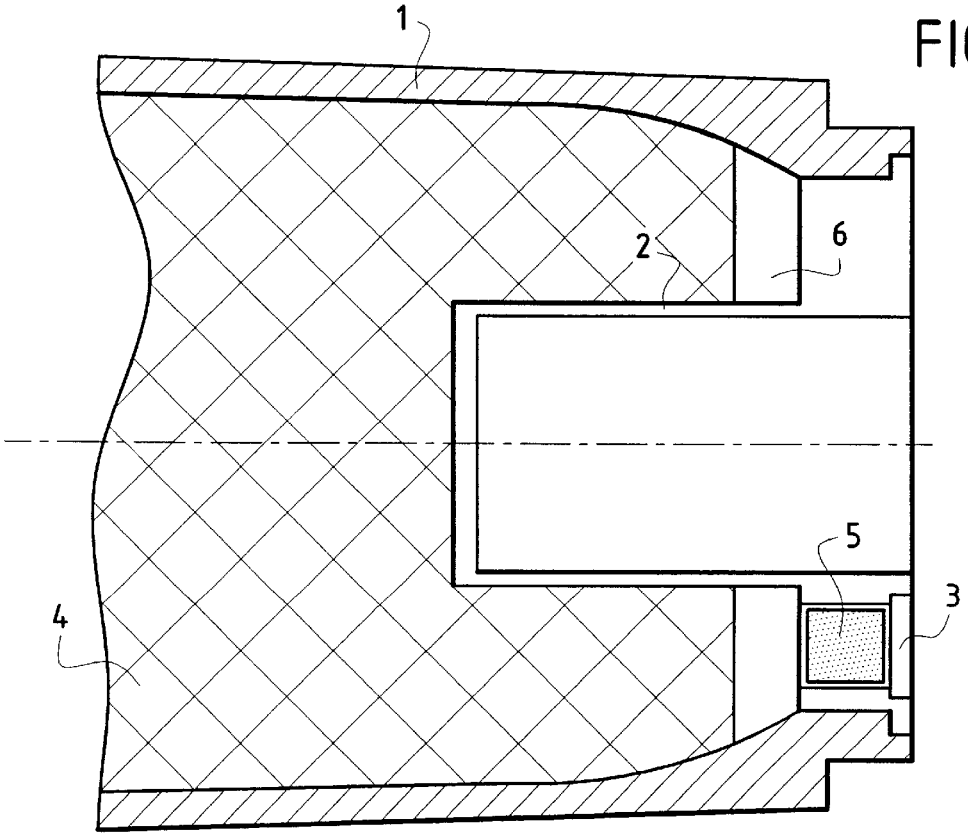

According to the alternative form represented in FIG. 2, the cylindrical safety igniter 5 is situated in the chamber 6, wedged by a ring of polyurethane foam not represented in the figure.

EXAMPLES

The following nonlimiting examples illustrate the invention and the advantages which it provides.

Examples 1 and 2

Safety Igniters According to the Invention of Composite Explosive Based on Pentrite According to these 2 examples, the igniters are provided in the form of a cylindrical block generated by rotation having a diameter of 30 mm. The height of the block is 15 mm for Example 1 and 30 mm for Example 2. The mass of the igniter is 17 g for Example 1 and 34 g for Example 2. The composite explosive constituting these 2 igniters is composed of 40% by weight of octogen, of 44% by weight of pentrite and of 16% by weight of a polyurethane binder based on polyoxypropylenetriol and on isophorone diisocyanate.

To obtain these 2 blocks, the pulverulent pentrite and the pulverulent octogen were first of all mixed with the alcohol and then the isocyanate [lacuna] added. The paste obtained was subsequently cast in 2 moulds with the appropriate dimensions and then the paste was polymerized for 7 d at 60° C.

These igniters exhibit no specific toxicity, in particular in the case of contact with the skin. The combustion gases are not dangerous. The only thing which can be found in this respect is irritation of the eye and respiratory mucous membranes (watering of the eyes, coughing), without any medium- and long-term after-effect on the health.

Example 3

Explosive Munition Component of Penetrator Type According to the Invention

A penetrator weighing 280 kg, with a calibre of 285 mm, comprising an approximately cylindrical steel structure and 85 kg of a composite explosive charge composed of octogen, ammonium perchlorate and aluminium as charges and of a polyurethane binder based on hydroxyl [sic] polybutadiene and on isophorone diisocyanate as cross-linking agent, was prepared according to conventional techniques well known to a person skilled in the art.

This penetrator was equipped, first, with a device for deconfinement of the structure composed of protective caps which can burst and, secondly, with the safety igniter obtained according to Example 1, according to an arrangement in accordance with that represented diagrammatically in FIG. 1.

The safety igniter was inserted, during the preparation of the charge, in the explosive paste after its casting and before its polymerization, so that it is entirely integral with the charge.

This penetrator also comprises a chamber for expansion of the gases with a volume of 250 $cm^3$ positioned as according to FIG. 1.

This penetrator was subjected to cook off of 3.3° C. per hour using an appropriate oven.

When the temperature reaches 142±4° C., ignition of the safety igniter is observed, followed by a simple combustion reaction of the charge of the munition, without fragmentation or propulsion of the structure. The value of 142° C. corresponds to the mean of 10 thermocouples installed at different positions in the oven.

A numerical simulation shows that, without a safety igniter, a reaction of unknown intensity would have taken place at a temperature of the oven of approximately 208° C.

Examples 4 to 6

Large-calibre Explosive Munition Components for Submarine Use According to the Invention

Example 4

An explosive munition component for submarine use, with a calibre of 500 mm, comprising an approximately cylindrical steel structure and 150 kg of a composite explosive charge composed of hexogen, ammonium perchlorate and aluminium as charges and of a polyurethane binder based on hydroxyl [sic] butadiene and on isophorone diisocyanate as cross-linking agent, was prepared according to conventional techniques well known to a person skilled in the art.

This munition was equipped, first, with a device for deconfinement of the structure composed of protective caps which can burst and, secondly, with the safety igniter obtained according to Example 2, according to an arrangement in accordance with that represented diagrammatically in FIG. 1.

The safety igniter was inserted in the charge as is described for Example 3.

This munition also comprises a chamber for expansion of the gases with a volume of 400 $cm^3$ positioned as according to FIG. 1.

This explosive munition component for submarine use was subjected to slow cook off of 3.3° C. per hour using an appropriate oven.

When the temperature of the oven reaches 147° C., ignition of the safety igniter is observed, followed by a simple combustion reaction of the charge of the munition, without fragmentation or propulsion of the structure.

Another test, carried out starting from an exactly identical munition component but one devoid of safety igniter, results, when the temperature of the oven reaches 188° C., in a violent combustion reaction, with fragmentation of the structure and projection of fragments beyond a distance of 15 m.

Examples 5 and 6

An explosive munition component identical to that of Example 4 was prepared for each of these Examples 5 and 6, except that:

for Example 5, the safety igniter has a diameter of 80 mm and a height of 80 mm, for Example 6, the safety igniter has a diameter of 5 mm and a height of 5 mm.

During the same slow cook off test as for Example 4, ignition of the igniter is observed when the temperature of the oven reaches 130° C. for Example 5 and 170° C. for Example 6.

In both cases, this ignition of the igniter is followed by a simple combustion reaction of the charge of the munition, without fragmentation or propulsion of the structure.

What is claimed is:

1. Safety igniter for a pyrotechnic munition component comprising a structure in the form of a casing, and a solid pyrotechnic charge present in the structure, wherein the safety igniter, when the pyrotechnic munition component is subjected to slow cook-off, reacts by simple combustion at a temperature lower than the reaction temperature of the solid pyrotechnic charge, the combustion of the safety igniter leading to the combustion without detonation of the solid pyrotechnic charge, the safety igniter comprises a block of solid pyrotechnic composition having a content by weight of pentrite between 5% and 98%.

2. Safety igniter according to claim 1, wherein the block of solid pyrotechnic composition having a content by weight of pentrite between 5% and 98% is a composite explosive.

3. Safety igniter according to claim 1, wherein the block of solid pyrotechnic composition having a content by weight of pentrite between 5% and 98% is provided in the form of a cylinder generated by rotation having a diameter between 2 mm and 50 mm.

4. Pyrotechnic munition component comprising a structure in the form of a casing, a solid pyrotechnic charge present in the structure, a device for deconfinement of the structure and a safety igniter wherein the safety igniter comprises a block of solid pyrotechnic composition having a content by weight of pentrite between 5% and 98%, further wherein the safety igniter, when the pyrotechnic munition component is subjected to slow cook-off, reacts by simple combustion at a temperature lower than the reaction temperature of the solid pyrotechnic charge, the combustion of the safety igniter leading to the combustion without detonation of the solid pyrotechnic charge.

5. Pyrotechnic munition component according to claim 4, wherein the solid pyrotechnic charge present in the structure is an explosive charge.

6. Pyrotechnic munition component according to claim 4, wherein the solid pyrotechnic charge present in the structure is a propulsive charge.

7. Pyrotechnic munition component according to claim 4, wherein the safety igniter is situated close to the device for deconfinement of the structure.

8. Pyrotechnic munition component according to claim 4, wherein the safety igniter is at least partially embedded in the solid pyrotechnic charge.

9. Process for bringing about the combustion without detonation of a solid pyrotechnic charge, the solid pyrotechnic charge being part of a pyrotechnic munition component comprising a structure in the form of a casing, the solid pyrotechnic charge present in the structure, a device for deconfinement of the structure, and a safety igniter which, when the pyrotechnic munition component is subjected to slow cook-off, reacts by simple combustion at a temperature lower than the reaction temperature of the solid pyrotechnic charge, the combustion of the safety igniter leading to the combustion without detonation of the solid pyrotechnic charge, and wherein the safety igniter comprises a block of solid pyrotechnic composition having a content by weight of pentrite between 5% and 98%.

* * * * *